US012433322B2

(12) United States Patent
Liu et al.

(10) Patent No.: US 12,433,322 B2
(45) Date of Patent: Oct. 7, 2025

(54) WATER-BASED ELECTRONIC CIGARETTE LIQUID

(71) Applicants: CHINA TOBACCO HUNAN INDUSTRIAL CO., LTD., Hunan (CN); SHANGHAI NEW TOBACCO PRODUCT RESEARCH INSTITUTE CO., LTD., Shanghai (CN); CHINA TOBACCO HENAN INDUSTRIAL CO., LTD., ZhengZhou (CN)

(72) Inventors: Jianfu Liu, Hunan (CN); Jianhua Yi, Hunan (CN); Wen Du, Hunan (CN); Jiaruo Huang, Hunan (CN); Zhiguo Wang, Hunan (CN); Xinliang Tan, Hunan (CN); Kejun Zhong, Hunan (CN); Zhiwei Sun, Hunan (CN); Wei Liu, Hunan (CN); Jingbo Chen, Hunan (CN); Chao Tan, Hunan (CN); Chao Chen, Shanghai (CN); Chaoying Chen, Shanghai (CN); Jing Yang, Henan (CN); Qishan Yuan, Henan (CN); Xinqiang Yin, Hunan (CN); Xiaoyi Guo, Hunan (CN); Jianxin Ren, Hunan (CN)

(73) Assignees: CHINA TOBACCO HUNAN INDUSTRIAL CO., LTD., Hunan (CN); SHANGHAI NEW TOBACCO PRODUCT RESEARCH INSTITUTE CO., LTD., Shanghai (CN); CHINA TOBACCO HENAN INDUSTRIAL CO., LTD., ZhengZhou (CN)

( * ) Notice: Subject to any disclaimer, the term of this patent is extended or adjusted under 35 U.S.C. 154(b) by 84 days.

(21) Appl. No.: 17/425,707

(22) PCT Filed: Jan. 20, 2020

(86) PCT No.: PCT/CN2020/073137
§ 371 (c)(1),
(2) Date: Jul. 23, 2021

(87) PCT Pub. No.: WO2020/151638
PCT Pub. Date: Jul. 30, 2020

(65) Prior Publication Data

US 2024/0016198 A1 Jan. 18, 2024

(30) Foreign Application Priority Data

Jan. 25, 2019 (CN) ..... 201910072584.6

(51) Int. Cl.
*A24B 15/167* (2020.01)
*A24B 15/30* (2006.01)
*A24B 15/32* (2006.01)

(52) U.S. Cl.
CPC ..... *A24B 15/167* (2016.11); *A24B 15/302* (2013.01); *A24B 15/32* (2013.01)

(58) Field of Classification Search
None
See application file for complete search history.

(56) References Cited

U.S. PATENT DOCUMENTS

| | | | | |
|---|---|---|---|---|
| 10,045,976 | B2 | 8/2018 | Fusco et al. | |
| 2013/0206150 | A1* | 8/2013 | Duggins | A23G 3/48 131/355 |
| 2013/0263870 | A1* | 10/2013 | Cantrell | A24B 15/14 131/355 |
| 2015/0230515 | A1* | 8/2015 | Lampe | A23G 4/068 131/352 |
| 2017/0333415 | A1* | 11/2017 | Williams | A61M 11/005 |

FOREIGN PATENT DOCUMENTS

| | | | | |
|---|---|---|---|---|
| CN | 103893026 | A * | 7/2014 | |
| CN | 104068470 | A | 10/2014 | |
| CN | 104087415 | A | 10/2014 | |
| CN | 104336777 | A * | 2/2015 | A24B 15/16 |
| CN | 104432491 | A * | 3/2015 | A24B 15/28 |
| CN | 105962426 | A | 9/2016 | |
| CN | 106562469 | A | 4/2017 | |
| CN | 106659233 | A * | 5/2017 | A24F 13/18 |
| CN | 108264961 | A * | 7/2018 | |
| WO | WO-2014187770 | A2 * | 11/2014 | |
| WO | WO-2016184978 | A1 * | 11/2016 | |
| WO | WO-2017167508 | A1 * | 10/2017 | A24F 40/10 |
| WO | 2017/189375 | A1 | 11/2017 | |
| WO | WO-2018099664 | A1 * | 6/2018 | A24F 40/10 |

OTHER PUBLICATIONS

CN104432491 English machine translation Mar. 25, 2015.*
CN-104336777A English machine translation Feb. 11, 2015.*
CN106659233A English Machine translation May 10, 2017.*
CN108264961A English machine translation Jul. 10, 2018.*
CN-103893026-A, English machine translation from PE2E (Year: 2014).*
International Search Report issued in International Application No. PCT/CN2020/073137 dated Apr. 24, 2020, 2 pages.

* cited by examiner

*Primary Examiner* — Michael H. Wilson
*Assistant Examiner* — Michael T Fulton
(74) *Attorney, Agent, or Firm* — MASCHOFF BRENNAN; Ran Pang; Michael Mauriel

(57) ABSTRACT

A water-based electronic cigarette liquid is disclosed. The water-based electronic cigarette liquid includes the following ingredients in parts by mass: 5-60 parts of water, 5-50 parts of smoke ingredient which is solid at normal temperature and is soluble in water, and 0-30 parts of glycerol. The electronic cigarette liquid in this invention has environmental protection, high safety, comfortable smoking taste, high smoke producing effect, and low viscosity.

28 Claims, No Drawings

WATER-BASED ELECTRONIC CIGARETTE LIQUID

CROSS REFERENCE TO RELATED APPLICATIONS

This application is a U.S. National Phase application under 35 U.S.C. § 371 of International Application No. PCT/CN2020/073137 filed on Jan. 20, 2020 which claims priority to Chinese Application No. 201910072584.6 filed on Jan. 25, 2019. The entire content of these applications is hereby incorporated herein by reference.

FIELD OF THE INVENTION

The present application relates to the field of electronic cigarette liquid, and particularly to a water-based electronic cigarette liquid.

BACKGROUND OF THE INVENTION

Main ingredients of electronic cigarettes on the present market are glycerin and propylene glycol. Glycerol mainly produces smoke by atomization. Due to poor dissolution, weak fluidity and high viscosity of glycerol, propylene glycol has to be added to the atomizing agent. The propylene glycol functions to dissolve flavors and fragrances, improve the fluidity of the atomizing agent, and produce smoke by atomization. Traditionally, glycerin is considered safe to the human body. The Standards of Using Food Additives (GB2760-2014) provides that glycerin can be used for multiple purposes, and its daily maximum limit is required by production. However, propylene glycol is not safe, and GB2760-2014 allows its use in only two fields: wet flour products (such as noodles, dumpling wrappers, wonton wrappers, siumai wrappers) and cakes, and its daily maximum limits are respectively 1.5 and 3.0 g/kg.

Traditional glycerol is considered sweet and greasy, and has a heavy sense of chemistry when smoking, and its smoking sense is more difficult for users to accept than that of traditional cigarettes.

The electronic cigarette liquid mainly containing glycerol and propylene glycol has high viscosity and boiling point, is high power-consuming, and is easily carbonized on an atomizer. When the atomization temperature is more than 200° C., glycerol and propylene glycol may produce alcohol and ketone compounds to endanger user's health.

In long-term understanding, water has a great impact on the atomization effect of the traditional electronic cigarette liquid using glycerin and propylene glycol as main atomizing agents, and when the water content of the electronic cigarette liquid is more than 10%, the atomization amount of electronic cigarettes is remarkable reduced.

Therefore, it is necessary to develop a new water-based electronic cigarette liquid, including a little or even no propylene glycol and glycerin, which ensures certain smoke produced and improves the security and smoking taste of the electronic cigarette liquid, and the electronic cigarette liquid has lower viscosity and boiling point to protect the smoking set.

SUMMARY OF THE INVENTION

The technical problem to be solved by the present invention is to overcome the shortcomings of the prior art, and the present invention provides an electronic cigarette liquid with environment friendliness, high security, comfortable taste, high smoke producing efficiency and low viscosity.

To solve the above technical problem, the present invention adopts the following technical solution:

A water-based electronic cigarette liquid includes the following ingredients in parts by mass: 5-60 parts of water, 5-50 parts of smoke providing ingredient which is solid at normal temperature and is soluble in water, and 0-30 parts of glycerol. The smoke providing ingredient is sugar alcohol. In the traditional understanding, it is generally considered that sugar alcohol is a crystalline solid, does not have fluidity and cannot be used as an electronic cigarette atomizing agent; meanwhile, in the traditional understanding, water has a great impact on the atomization effect of the traditional electronic cigarette liquid using glycerin and propylene glycol as main atomizing agents, and when the water content of the electronic cigarette liquid is more than 10%, the atomization amount of electronic cigarettes is remarkable reduced. In the present invention, when the water-based electronic cigarette liquid is prepared, sugar alcohol is used as a smoke providing ingredient and dissolved in water to form a main atomization ingredient of the electronic cigarette liquid.

Further, the water-based electronic cigarette liquid has a low viscosity. The low viscosity in the present invention refers to a viscosity lower than the viscosity of glycerol+propylene glycol electronic cigarette liquid at normal temperature and pressure. Specifically, the viscosity is less than or equal to 200 mPa·s, or less than or equal to 150 mPa·s, or less than or equal to 100 mPa·s, or less than or equal to 75 mPa·s, or less than or equal to 50 mPa·s, or less than or equal to 25 mPa·s, or less than or equal to 20 mPa·s, or less than or equal to 15 mPa·s, or less than or equal to 12 mPa·s, or more than or equal to 1.1 mPa·s. Based on a large number of experiments, it is found that water can reduce the viscosity of electronic cigarette liquid, so the viscosity of the water-based electronic cigarette liquid is smaller than that of glycerol and propylene glycol electronic cigarette liquid, the water-based electronic cigarette liquid can be used under lower power, the heating power is reduced, carbonized coking caused by high heating filament temperature was avoided, and the service life of a battery can be prolonged.

Further, the water-based electronic cigarette liquid has a low boiling point. The low boiling point in the present invention refers to a boiling point lower than that of glycerol and propylene glycol electronic cigarette liquid at normal temperature and pressure. Specifically, the boiling point is less than or equal to 180° C., or less than or equal to 160° C., or less than or equal to 140° C., or less than or equal to 120° C., or less than or equal to 110° C., or more than or equal to 103° C. Based on a large number of experiments, it is found that the boiling point of the water-based electronic cigarette liquid containing sugar alcohol is smaller than that of glycerol+propylene glycol electronic cigarette liquid, so that the water-based electronic cigarette liquid can be used under lower power, the heating power is reduced, carbonized coking caused by high heating filament temperature was avoided, and the service life of a battery can be prolonged.

Further, the water-based electronic cigarette liquid has a high specific heat capacity. The high specific heat capacity described in the present invention refers to a specific heat capacity higher than that of glycerol and propylene glycol electronic cigarette liquid at normal temperature under normal pressure. Specifically, the specific heat capacity is more than or equal to 2.8 J/(g·° C.), or more than or equal to 2.9 J/(g·° C.), or more than or equal to 3.0 J/(g° C.), or more than or equal to 3.1 J/(g·° C.), or more than or equal to 3.2 J/(g·°

C.), or more than or equal to 3.3 J/(g·° C.), or more than or equal to 3.4 J/(g·° C.), or more than or equal to 3.5 J/(g·° C.). Based on a large number of experiments, it is found that the specific heat capacity of the water-based electronic cigarette liquid containing sugar alcohol is greater than that of glycerol+propylene glycol electronic cigarette liquid, which prevents excessive heating of electronic cigarettes, resulting in cracking of organic ingredients to produce a large amount of harmful substances.

Further, the water-based electronic cigarette liquid has an average atomization quantity more than or equal to 0.80 μg/puff during smoking, and the atomization quantity is the weight of aerosol captured. It is found by studies that the electronic cigarette liquid containing a mixture of sugar alcohol in water has a high smoke producing effect, and its smoke amount is not less than that of a mixture of glycerol and propylene glycol.

Further, the water-based electronic cigarette liquid has an average formaldehyde content less than or equal to 1.00 μg/puff and an average acetaldehyde content less than or equal to 0.5 μg/puff during smoking. It is found by a large number of experiments that the water-based electronic cigarette atomizing agent has better safety than traditional electronic cigarette liquid in the generation of carbonyl compounds.

Further, the water-based electronic cigarette liquid consists of the following ingredients in parts by mass: 10-50 parts of sugar alcohol, 0-30 parts of glycerol, and 20-50 parts of water.

Further, the water-based electronic cigarette liquid consists of the following ingredients in parts by mass: 20-30 parts of sugar alcohol, 0-10 parts of glycerol, and 20-40 parts of water.

Further, the sugar alcohol is selected from at least one of erythritol, xylitol, mannitol and sorbitol; preferably a mixture of erythritol and xylitol in a mass ratio is 1:1 to 1:4; more preferably a mixture of erythritol, sorbitol and xylitol, wherein the mass ratio of erythritol to xylitol is 1:1 to 1:4, and the mass ratio of erythritol to sorbitol is 1:1 to 1:4. It is found by a large number of experiments that when the sugar alcohol is a mixture of erythritol and xylitol in a mass ratio is 1:1 to 1:4, particularly when sorbitol is added in a mass ratio of erythritol to sorbitol of 1:1 to 1:4, the smoke producing effect, physical properties and taste of the water-based electronic cigarette have reached the optimal balance. In the present invention, propylene glycol is replaced with water as a solvent in the atomizing agent, and compared with the propylene glycol, the water has better safety. Erythritol, xylitol, mannitol and sorbitol are common sugar substitutes and have been generally accepted, and their safety has also accepted long-term tests. Therefore, even if the electronic cigarette of the present invention is eaten by mistake, serious consequences will not be produced.

Further, the water-based electronic cigarette liquid includes substances for increasing fragrance and/or a tobacco extract, the substances for increasing fragrance include cigarette essence and/or cigarette flavor and are preferably 0.01-10 parts in mass, and the tobacco extract is preferably 0-20 parts in mass. The essence is generally liquid, the flavor is generally solid, and the solvent of essence and/or flavor is mainly water. In order to promote dissolution and inhibit mildew, a small amount of propylene glycol or ethanol can be added as a dissolution promoter or mildew inhibitor, without affecting the taste or bringing a drunken effect to consumers.

A water-based electronic cigarette liquid includes the following ingredients in parts by mass: parts of water, and 5-50 parts of smoke providing ingredient which is solid at normal temperature and is soluble in water. The smoke providing ingredient is sugar alcohol.

Further, the water-based electronic cigarette liquid does not include propylene glycol. Because propylene glycol and its product generated after heating have adverse effects on human body, after a large number of experiments, the present invention obtains a water-based electronic cigarette liquid containing no propylene glycol by adjusting ingredient proportions, which obtains good smoke producing performance and has higher safety than the traditional electronic cigarette liquid. In addition, sugar alcohol can suppress poor taste of glycerol to a certain extent. When propylene glycol is inevitably used as a functional auxiliary agent such as a dissolution promoter or mildew inhibitor, the water-based electronic cigarette liquid includes less than or equal to 5 parts of propylene glycol.

Further, the water-based electronic cigarette includes glycerin less than or equal to 30 parts, or less than or equal to 25 parts, or less than or equal to 20 parts, or less than or equal to 15 parts, or less than or equal to 10 parts, or less than or equal to 5 parts, and preferably does not include glycerol and propylene glycol. Based on a large number of experiments, it is found that glycerol and propylene glycol have very thick sweet feeling and chemical smell in addition to generating carbonyl substances after atomization, so in order to improve the taste of smoke, glycerol and propylene glycol are removed from the ingredients of the water-based electronic cigarette liquid.

Further, in the process of continuous smoking, the water-based electronic cigarette liquid has a stable atomization effect. It is found by a large number of experimental assays that, compared to traditional electronic cigarette liquid, the propylene glycol-free water-based electronic cigarette liquid containing glycerol or not has a very stable smoke producing volume.

Further, the atomization effect floating value of the water-based electronic cigarette liquid is $S_{EFFECT}$, the number of puffs of the water-based electronic cigarette liquid is n, the atomization quantity corresponding to the i-th puff of the water-based electronic cigarette liquid is $S_i$, the average atomization quantity of the water-based electronic cigarette liquid per puff is $\overline{S}$, and the parameters satisfy $$S_{EFFECT} = \frac{\sqrt{\frac{\sum_{i=1}^{n}(S_i - \overline{S})^2}{n-1}}}{S} \leq 0.1.$$

The atomization effect floating value of the water-based electronic cigarette liquid can be obtained from the above formula. After a large number of experimental assays, it can be confirmed that the propylene glycol-free water-based electronic cigarette liquid containing glycerol or not has a very stable atomization effect, and the atomization effect floating value is always kept less than 0.1.

Further, the mass ratio of the water to the smoke providing ingredient is 1:4 to 4:1; further, the mass ratio of the water to the smoke providing ingredient is 1:4 to 1:1. When the water content is too high, the smoke providing ingredient cannot help water vapor form enough smoke; and when the content of the smoke providing ingredient is too high, the fluidity of the solution is poor, and crystal is easily produced, which is not conducive to the normal operation of electronic cigarettes.

Compared with the prior art, the advantages of the present invention are:

1. The design scheme of the atomizing agent using sugar alcohol and water as main ingredients obtains better safety and smoking taste than the traditional atomizing agent of glycerol+propylene glycol.
2. The design scheme of the atomizing agent using sugar alcohol and water as main ingredients obtains lower viscosity and boiling point than traditional formulas, and can reduce carbonization, prolong the service life of a battery and reduce the production cost of a smoking set.
3. This formula has the advantages of low cost and simple production.

DETAILED DESCRIPTION OF EMBODIMENTS

The features and advantages of this patent will be described in detail below in specific embodiments, its content is sufficient for those skilled in the art to understand the technical content of this patent and implement same, and those skilled in the art can readily understand the purposes and advantages of this patent according to the description, claims and drawings.

Example 1

S1: erythritol and xylitol were dissolved in water, wherein the mass ratio of erythritol, xylitol and water was 1:4:6.

S2: a caramel tobacco water-soluble flavor was mixed with the mixture of S1 uniformly to obtain an electronic cigarette liquid of this example, wherein the mass ratio of the caramel tobacco water-soluble flavor to the mixture of S1 was 1:10.

Example 2

S1: erythritol and xylitol were dissolved in water, wherein the mass ratio of erythritol, xylitol and water was 1:4:4.

S2: a tobacco extract was mixed with the mixture of S1 uniformly to obtain an electronic cigarette liquid of this example, wherein the mass ratio of the tobacco extract to the mixture of S1 was 1:10.

Example 3

S1: erythritol and xylitol were dissolved in water, wherein the mass ratio of erythritol, xylitol and water was 1:4:5.

S2: an orangeade water-soluble flavor was mixed with the mixture of S1 uniformly to obtain an electronic cigarette liquid of this example, wherein the mass ratio of the orangeade water-soluble flavor to the mixture of S1 was 1:10.

Example 4

S1: erythritol, mannitol and glycerol were dissolved in water, wherein the mass ratio of erythritol, mannitol, glycerin and water was 1:4:2:6.

S2: a caramel tobacco water-soluble flavor was mixed with the mixture of S1 uniformly to obtain an electronic cigarette liquid of this example, wherein the mass ratio of the caramel tobacco water-soluble flavor to the mixture of S1 was 1:10.

Example 5

S1: erythritol, xylitol and glycerol were dissolved in water, wherein the mass ratio of erythritol, xylitol, glycerin and water was 1:4:2:5.

S2: a hawthorn water-soluble flavor was mixed with the mixture of S1 uniformly to obtain an electronic cigarette liquid of this example, wherein the mass ratio of the hawthorn water-soluble flavor to the mixture of S1 was 1:10.

Example 6

S1: erythritol, xylitol and glycerol were dissolved in water, wherein the mass ratio of erythritol, xylitol, glycerin and water was 1:6:4:10.

S2: a hawthorn water-soluble flavor was mixed with the mixture of S1 uniformly to obtain an electronic cigarette liquid of this example, wherein the mass ratio of the hawthorn water-soluble flavor to the mixture of S1 was 1:19.

Example 7

S1: erythritol, xylitol, sorbitol and glycerol were dissolved in water, wherein the mass ratio of erythritol, xylitol, sorbitol, glycerol and water was 1:4:1:2:5.

S2: a mint water-soluble flavor was mixed with the mixture of S1 uniformly to obtain an electronic cigarette liquid of this example, wherein the mass ratio of the mint water-soluble flavor to the mixture of S1 was 1:10.

Example 8

S1: erythritol, xylitol, sorbitol, mannitol and glycerol were dissolved in water, wherein the mass ratio of erythritol, xylitol, sorbitol, mannitol, glycerol and water was 1:4:1:1:2:5.

S2: a caramel tobacco water-soluble flavor was mixed with the mixture of S1 uniformly to obtain an electronic cigarette liquid of this example, wherein the mass ratio of the caramel tobacco water-soluble flavor to the mixture of S1 was 1:20.

Example 9

S1: xylitol was dissolved in water, wherein the mass ratio of xylitol to water was 1:1.

S2: a caramel tobacco water-soluble flavor was mixed with the mixture of S1 uniformly to obtain an electronic cigarette liquid of this example, wherein the mass ratio of the caramel tobacco water-soluble flavor to the mixture of S1 was 1:20.

Example 10

S1: erythritol was dissolved in water, wherein the mass ratio of erythritol to water was 1:4.

S2: an orangeade water-soluble flavor was mixed with the mixture of S1 uniformly to obtain an electronic cigarette liquid of this example, wherein the mass ratio of the orangeade water-soluble flavor to the mixture of S1 was 1:20.

Examples 11-59 and Comparative Examples 1-8

Raw materials were mixed uniformly according to the mass ratio of ingredients in Table 1 to obtain electronic cigarette liquid of Examples 11-59 and Comparative Examples 1-8.

TABLE 1

| Mass ratio of ingredients in Examples 11-59 | | | | | | |
|---|---|---|---|---|---|---|
| | Erythritol | Xylitol | Sorbitol | Propylene glycol | Glycerin | Water |
| Example 11 | | 20 | | | | 80 |
| Example 12 | | 50 | | | | 50 |
| Example 13 | | 65 | | | | 35 |
| Example 14 | 20 | | | | | 80 |
| Example 15 | 50 | | | | | 50 |
| Example 16 | 80 | | | | | 20 |
| Example 17 | | | 20 | | | 80 |
| Example 18 | | | 50 | | | 80 |
| Example 19 | | | 80 | | | 20 |
| Example 20 | 10 | 30 | 10 | | | 50 |
| Example 21 | 10 | 10 | 10 | | | 70 |
| Example 22 | 20 | 30 | | | | 50 |
| Example 23 | 30 | 20 | | | | 50 |
| Example 24 | | 25 | 25 | | | 50 |
| Example 25 | | 40 | | | 10 | 50 |
| Example 26 | 40 | | | | 10 | 50 |
| Example 27 | | | 40 | | 10 | 50 |
| Example 28 | | 20 | | | | 80 |
| Example 29 | | 20 | | 5 | 20 | 55 |
| Example 30 | | 40 | | 5 | 10 | 45 |
| Example 31 | | 65 | | 5 | 5 | 25 |
| Example 32 | 20 | | | 5 | 20 | 55 |
| Example 33 | 40 | | | 5 | 5 | 50 |
| Example 34 | 55 | | | 5 | 5 | 35 |
| Example 35 | | | 20 | 5 | 20 | 55 |
| Example 36 | | | 30 | 5 | 10 | 55 |
| Example 37 | | | 50 | 5 | 5 | 40 |
| Example 38 | 10 | 10 | | 5 | 20 | 55 |
| Example 39 | 20 | 20 | | 5 | 10 | 45 |
| Example 40 | 30 | 20 | | 5 | 5 | 40 |
| Example 41 | 10 | | 10 | 5 | 20 | 55 |
| Example 42 | 20 | | 20 | 5 | 10 | 45 |
| Example 43 | 30 | | 20 | 5 | 5 | 40 |
| Example 44 | 20 | | 30 | 5 | 5 | 40 |
| Example 45 | | 10 | 10 | 5 | 20 | 55 |
| Example 46 | | 20 | 20 | 5 | 10 | 45 |
| Example 47 | | 30 | 20 | 5 | 5 | 40 |
| Example 48 | | 20 | 30 | 5 | 5 | 40 |
| Example 49 | 5 | 5 | 5 | 5 | 20 | 60 |
| Example 50 | 10 | 10 | 5 | 5 | 5 | 60 |
| Example 51 | 20 | 20 | 5 | 5 | 5 | 45 |
| Example 52 | 5 | 10 | | 5 | 5 | 75 |
| Example 53 | | 40 | | | | 60 |
| Example 54 | | 30 | | | | 70 |
| Example 55 | | 50 | | | 10 | 40 |
| Example 56 | | 20 | | | 10 | 70 |
| Example 57 | | 50 | | | 20 | 30 |
| Example 58 | | 30 | | | 20 | 50 |
| Example 59 | | 10 | | | 20 | 70 |
| Comparative Example 1 | | | | | 1 | 10 |
| Comparative Example 2 | | | | | 1 | 5 |
| Comparative Example 3 | | | | | 1 | 2 |
| Comparative Example 4 | | | | | 1 | 1 |
| Comparative Example 5 | | | | | 2 | 1 |
| Comparative Example 6 | | | | | 4 | 1 |
| Comparative Example 7 | | | | | 10 | 1 |
| Comparative Example 8 | | | | 28.5 | 66.5 | |

Test I for Carbonyl Compounds

In the field of electronic cigarette research, the safety of electronic cigarette liquid was usually measured using a method for measuring the content of aldehyde ketone in an aerosol.

1) Samples selected for test: propylene glycol, glycerin, blank atomizing agent, commercially available electronic cigarette liquid sample 70 (Doulton® No. 1 electronic cigarette liquid), commercially available electronic cigarette liquid sample 82 (Huanghelou® electronic cigarette liquid), mixture samples obtained in step 1 of Example 1 (code S1, totally two samples, respectively S1-1 and S1-2), and electronic cigarette liquid obtained in step 2 of Example 1 (code S2, totally two samples, respectively S2-1 and S2-2).

2) Test method 2.1) Linear smoking set test step: the above samples were respectively perfused in electronic cigarette smoking sets, smoking was performed with linear smoking sets (model: SM450) according to a bell curve, and the electronic cigarette smoking set was connected to an external constant voltage source 4.5 V during smoking. Smoking mode: the smoking curve was a square wave curve, the smoking capacity was 55 ml, the smoking time was 3 seconds per puff, the interval was 30 seconds, and the number of puffs was 30. Smoke was captured with two 45 mm Cambridge glass fiber filters (containing an aldehyde ketone derivative reagent).

2.2) High performance liquid chromatography test step: the contents of main carbonyl compounds in the captured smoke were measured by an industry standard method: Cigarettes Determination of major carbonyl compounds in mainstream cigarette smoke High performance liquid chromatographic method.

2.3) Electronic cigarette and smoking set synchronization step: the traditional atomizer (resistance wire+liquid guide cotton) was synchronous with the smoking set by means of a stabilized voltage supply module (maximum voltage 6.2 V, test voltage 4 V); the ultrasonic atomizer was not connected to any external device, but connected to its battery, and was manually turned on or off to synchronize with the smoking set.

2.4) Step of verifying whether an absorption bottle was required: a high content of aldehyde ketone standard was added to a blank atomizing agent, an absorption bottle filled with 10 ml of aldehyde ketone derivative reagent was connected to the smoking set for test on the basis of the above experimental method, and the experimental results showed that aldehyde ketone was not detected in the absorption bottle derivative. Therefore, the capture device of the smoking set can collect aldehyde ketone compounds in 30 puffs of electronic cigarette smoke in the presence of two filters, without requiring any absorption bottle.

The test results were as follows:

TABLE 2

Aldehyde ketone data of propylene glycol, glycerin, and blank atomizing agent in traditional atomizers

| Sample | Formaldehyde | Acetaldehyde | Acetone | Propionaldehyde | Butyraldehyde | Atomization quantity (g) |
|---|---|---|---|---|---|---|
| | Filter capture indicator (μg) | | | | | |
| Blank atomizing agent | 4.27 | 0.88 | 0.15 | 0 | 0 | 0.1242 |
| Propylene glycol | 13.60 | 17.16 | 0.90 | 0 | 2.39 | 0.1134 |
| Glycerin | 192.51 | 28.33 | 0.49 | 15.31 | 4.61 | 0.0886 |
| | Atomization content (μg/g) | | | | | |
| Blank atomizing agent | 34.40 | 7.08 | 1.17 | 0.00 | 0.00 | 0.1242 |
| Propylene glycol | 119.92 | 151.35 | 7.95 | 0.00 | 21.08 | 0.1134 |
| Glycerin | 2172.85 | 319.76 | 5.52 | 172.80 | 52.03 | 0.0886 |
| | Content (μg/puff) | | | | | |
| Blank atomizing agent | 0.14 | 0.03 | 0.00 | 0.00 | 0.00 | 0.1242 |
| Propylene glycol | 0.45 | 0.57 | 0.03 | 0.00 | 0.08 | 0.1134 |
| Glycerin | 6.42 | 0.94 | 0.02 | 0.51 | 0.15 | 0.0886 |

TABLE 3

Aldehyde ketone data of two commercially available electronic cigarette liquids in traditional atomizers

| Sample | Formaldehyde | Acetaldehyde | Acetone | Propionaldehyde | Butyraldehyde | Atomization amount (g) |
|---|---|---|---|---|---|---|
| | Filter capture indicator (μg) | | | | | |
| 70 | 51.90 | 15.37 | 0.43 | 1.49 | 1.51 | 0.0858 |
| 82 | 4.39 | 7.19 | 0.03 | 0.95 | 0.00 | 0.1205 |
| | Atomization content (μg/g) | | | | | |
| 70 | 604.90 | 179.14 | 5.01 | 17.37 | 17.60 | 0.0858 |
| 82 | 36.43 | 59.67 | 0.25 | 7.88 | 0.00 | 0.1205 |

TABLE 3-continued

| Aldehyde ketone data of two commercially available electronic cigarette liquids in traditional atomizers | | | | | | |
|---|---|---|---|---|---|---|
| Sample | Formaldehyde | Acetaldehyde | Acetone | Propionaldehyde | Butyraldehyde | Atomization amount (g) |
| | Content (μg/puff) | | | | | |
| 70 | 1.73 | 0.51 | 0.01 | 0.05 | 0.05 | 0.0858 |
| 82 | 0.15 | 0.24 | 0.00 | 0.03 | 0.00 | 0.1205 |

TABLE 4

| Aldehyde ketone data of S1 and S2 samples in traditional atomizers | | | | | | |
|---|---|---|---|---|---|---|
| Sample | Formaldehyde | Acetaldehyde | Acetone | Propionaldehyde | Butyraldehyde | Atomization amount (g) |
| | Filter capture indicator (μg) | | | | | |
| S1-1 | N.D. | N.D. | N.D. | N.D. | N.D. | 0.4411 |
| S1-2 | N.D. | N.D. | N.D. | N.D. | N.D. | 0.4214 |
| S2-1 | N.D. | N.D. | N.D. | N.D. | N.D. | 0.4411 |
| S2-2 | N.D. | N.D. | N.D. | N.D. | N.D. | 0.4234 |
| | Atomization content (μg/g) | | | | | |
| S1-1 | N.D. | N.D. | N.D. | N.D. | N.D. | 0.4251 |
| S1-2 | N.D. | N.D. | N.D. | N.D. | N.D. | 0.4112 |
| S2-1 | N.D. | N.D. | N.D. | N.D. | N.D. | 0.4142 |
| S2-2 | N.D. | N.D. | N.D. | N.D. | N.D. | 0.4123 |
| | Content (μg/puff) | | | | | |
| S1 | N.D. | N.D. | N.D. | N.D. | N.D. | 0.4114 |
| S2 | N.D. | N.D. | N.D. | N.D. | N.D. | 0.4234 |

Note:
N.D. = No detected

From the contrast of Tables 2-4, no carbonyl compounds or other harmful substances were discovered in the water-based electronic cigarette atomizing agent or after the water-based electronic cigarette liquid of the present invention was atomized. Compared to gas phase ingredients of ordinary electronic cigarette atomizing agents, this water-based atomizing agent had better safety.

Smoke Capture Test I

The electronic cigarette liquid of Example 6 was perfused in an electronic cigarette smoking set, smoking was performed with the linear smoking set (model: SM450) according to a bell curve, and the electronic cigarette smoking set was connected to an external constant voltage source 4.5 V during smoking. Smoking mode: the smoking curve was a square wave curve, the smoking time was 3 seconds per puff, and the interval was 30 seconds.

Smoke was captured with a 45 mm Cambridge glass fiber filter, and the smoke captured by the Cambridge filter was measured by weighing. Substances except water will be captured by the Cambridge filter to form smoke.

The smoke capture data of this example was shown in Table 4.

TABLE 5

| Smoke capture data of smoke capture test I | | | |
|---|---|---|---|
| | Filter capture weight (mg) | Instrument weight loss (mg) | Capture rate |
| First 30 puffs | 35.9 | 53.7 | 66.85% |
| Second 30 puffs | 35 | 50.7 | 69.03% |
| Third 30 puffs | 35.2 | 50.4 | 69.84% |
| Fourth 30 puffs | 35.4 | 50.3 | 70.38% |
| Fifth 30 puffs | 35.2 | 50.4 | 69.84% |
| Sixth 30 puffs | 35.5 | 50.4 | 70.44% |
| Seventh 30 puffs | 35.4 | 50.6 | 69.96% |

The filter capture weight can be considered as a gas phase ingredient after the atomizing agent was heated, i.e., smoke. The instrument weight loss was electronic cigarette liquid volatilized by heating in the electronic cigarette smoking set. Since water was not captured by the filter, the filter capture weight was less than the instrument loss weight. The capture rate can be calculated by combining the data of the two. Compared to the composition ratio of the electronic cigarette liquid, it can be found that the capture rate was directly proportional to the solute in the electronic cigarette liquid. Hence, the atomization quantity of the water-based electronic cigarette liquid of the present invention was directly proportional to the solute in the electronic cigarette liquid.

After the same electronic cigarette smoking set and the same electronic cigarette set was used with the electronic cigarette liquid consisting of pure glycerol, the filter and the smoking set were weighed before and after the experiment to obtain filter capture and smoking set weight loss data, as shown in Table 5.

TABLE 6

| Smoke capture data of pure glycerol | | | |
|---|---|---|---|
| | Filter capture weight (mg) | Instrument weight loss data (mg) | Capture rate |
| First 30 puffs | 55.6 | 51.4 | 108.17% |
| Second 30 puffs | 57.4 | 52.1 | 110.17% |

Since glycerol easily absorbed moisture in air, the filter capture weight was higher than the instrument weight loss data.

From the contrast of Table 5 and Table 6, the water-based electronic cigarette liquid of the present invention had an atomization quantity similar to glycerol, and when the solute content of the electronic cigarette liquid was 60%, the atomization quantity of the water-based electronic cigarette liquid was 60% of that of the pure glycerol electronic cigarette liquid under the same condition.

The electronic cigarette liquid of Examples 1-52 were added to ordinary electronic cigarette atomizers, and light blue smoke visible to the naked eye was produced during normal smoking. After continuous smoking, the smoke quantity was not significantly reduced, and the taste remained stable. Experiments showed that, compared to the glycerol-propylene glycol 1:1 electronic cigarette liquid, the capture weight of the atomizing agent with a water content of 50% in the present invention was approximately 50% of the capture weight of the glycerol-propylene glycol 1:1 electronic cigarette liquid. When the smoke generated by smoking was observed with naked eyes, the smoke quantity of the atomizing agent with a water content of 50% in the present invention was also approximately 50% of the smoke quantity of the glycerol-propylene glycol 1:1 electronic cigarette liquid.

Test II for Carbonyl Compounds

The water-based electronic cigarette liquid in the following examples were selected, their aerosols were collected, the aldehyde ketone contents per puff in the aerosols were analyzed and compared with the data of the traditional glycerol and propylene glycol electronic cigarette oil, and the specific data was shown in Table 7:

TABLE 7

| Comparison of carbonyl compounds of water-based electronic cigarette liquid and traditional electronic cigarette liquid | | | | | | |
|---|---|---|---|---|---|---|
| | Formaldehyde (μg/puff) | Acetaldehyde (μg/puff) | Acetone (μg/puff) | Acraldehyde (μg/puff) | Butyraldehyde (μg/puff) | Atomization quantity (g) |
| Example 12 | ND | ND | ND | ND | ND | 0.0398 |
| Example 14 | ND | ND | ND | ND | ND | 0.0224 |
| Example 15 | ND | ND | ND | ND | ND | 0.0514 |
| Example 16 | ND | ND | ND | ND | ND | 0.0613 |
| Example 20 | ND | ND | ND | ND | ND | 0.0488 |
| Example 22 | ND | ND | ND | ND | ND | 0.0498 |
| Example 25 | ND | ND | ND | ND | ND | 0.0413 |
| Example 30 | ND | ND | ND | ND | ND | 0.0422 |
| Example 33 | ND | ND | ND | ND | ND | 0.0387 |
| Example 38 | ND | ND | ND | ND | ND | 0.0451 |
| Example 41 | ND | ND | ND | ND | ND | 0.0377 |
| Example 44 | ND | ND | ND | ND | ND | 0.0431 |
| Example 49 | ND | ND | ND | ND | ND | 0.0412 |
| Example 51 | ND | ND | ND | ND | ND | 0.0411 |
| Comparative Example 8 | 1.73 | 0.51 | 0.01 | 0.05 | 0.05 | 0.0858 |

Sensory Evaluation Test I

In addition to weighing, naked eye observation and subjective evaluation can also be used to evaluate the smoke quantity of the water-based electronic cigarette liquid. The sensory quality of the electronic cigarette liquid according to the examples of the present invention was tested. The sensory quality evaluation criteria were shown in Table 8, including five evaluation items: smoke quantity, sweetness, irritation, foreign smell and aftertaste, the maximum scale of each evaluation item was 9 scores, and each evaluation item was scored in units of 1 score.

TABLE 8

| Sensory quality score standards of electronic cigarette liquid | | | | | |
|---|---|---|---|---|---|
| Score | Smoke quantity | Sweetness | Burnt smell | Foreign smell | Aftertaste |
| 9 | Adequate | Very light | Very light | Very light | Very good |
| 8 | Adequate | Light | Light | Light | Good |
| 7 | Relatively adequate | Lighter | Lighter | Lighter | Better |
| 6 | Slightly adequate | Slightly light | Slightly light | Slightly light | Slightly better |
| 5 | Medium | Medium | Medium | Medium | Medium |
| 4 | Slight | Slightly thick | Slightly thick | Slightly thick | Slightly bad |
| 3 | Lighter | Thicker | Thicker | Thicker | Relatively bad |
| 2 | Light | Thick | Thick | Thick | Bad |
| 1 | Very light | Very thick | Very thick | Very thick | Very bad |

Evaluation method: samples and sensory quality evaluation standard tables were provided for smoking evaluation technicians, and various indicators were evaluated according to the table.

Result statistics: the evaluation results of all the smoking evaluation technicians were valid, and arithmetic mean values of single evaluation results of the smoking evaluation technicians were solved, retained to a decimal, and summed to obtain a total score.

TABLE 9

Comparison of smoking evaluation data of water-based electronic cigarette liquid and traditional electronic cigarette liquid

| | Smoke quantity | Sweetness | Burnt smell | Foreign smell | Aftertaste | Total score |
|---|---|---|---|---|---|---|
| Example 12 | 6.8 | 8.5 | 7.7 | 9.0 | 9.0 | 41.0 |
| Example 14 | 4.1 | 8.8 | 8.1 | 8.4 | 8.2 | 37.6 |
| Example 15 | 7.1 | 8.7 | 7.8 | 8.8 | 8.2 | 40.4 |
| Example 16 | 8.1 | 8.1 | 7.2 | 8.1 | 7.8 | 39.3 |
| Example 20 | 7.2 | 8.1 | 8.1 | 8.3 | 8.2 | 39.9 |
| Example 22 | 6.8 | 8.6 | 7.6 | 8.4 | 8.3 | 39.7 |
| Example 25 | 5.1 | 8.6 | 7.9 | 8.1 | 8.0 | 37.7 |
| Example 30 | 7.7 | 7.7 | 7.0 | 8.0 | 8.1 | 38.5 |
| Example 33 | 6.8 | 8.2 | 8.0 | 8.0 | 8.3 | 39.0 |
| Example 38 | 7.1 | 8.0 | 7.2 | 8.2 | 7.9 | 38.3 |
| Example 41 | 6.4 | 8.1 | 8.1 | 7.8 | 8.0 | 38.4 |
| Example 44 | 6.6 | 8.2 | 7.8 | 8.0 | 8.1 | 38.7 |
| Example 49 | 6.4 | 7.8 | 7.4 | 8.0 | 7.8 | 37.4 |
| Example 51 | 6.4 | 8.0 | 7.7 | 8.2 | 7.9 | 38.2 |
| Comparative Example 8 | 8.7 | 3.2 | 8.7 | 3.4 | 2.7 | 26.7 |

Smoke Capture Test II

The electronic cigarette liquid prepared in Examples 20, 30 and 35 and Comparative Examples 1-8 were respectively perfused in storage bins of electronic cigarette smoking sets and smoked with smoking sets, and aerosols were captured with Cambridge filters. Weight changes of the Cambridge filters before and after capture in first 50 puffs were accurately weighed to obtain an average weight of aerosol per puff. The data of the electronic cigarette liquid in Examples 20, 30 and 35 and Comparative Examples 1-8 were compared to measure the smoke quantity of the water-based electronic cigarette liquid. Specific data was shown in Table 10:

TABLE 10

Comparison of smoke quantity per puff of water-based electronic cigarette liquid and traditional electronic cigarette liquid

| Sample number | Smoke quantity (μg/puff) |
|---|---|
| Example 20 | 1.12 |
| Example 30 | 0.88 |
| Example 35 | 1.12 |
| Comparative Example 1 | 0.07 |
| Comparative Example 2 | 0.11 |
| Comparative Example 3 | 0.21 |
| Comparative Example 4 | 0.51 |
| Comparative Example 5 | 0.69 |
| Comparative Example 6 | 1.21 |
| Comparative Example 7 | 1.82 |
| Comparative Example 8 | 1.71 |

According to the data of Table 10, the proportion of water in the traditional electronic cigarette liquid cannot be too high, otherwise, it will reduce smoke quantity and affect smoking quality. The addition of a smoke providing ingredient to water can obviously increase the smoke quantity.

The electronic cigarette liquid prepared in Examples 20, 30 and 35 were respectively perfused in storage bins of electronic cigarette smoking sets and smoked with smoking sets, and aerosols were captured with Cambridge filters.

Weight changes of the Cambridge filters before and after capture were accurately weighed to obtain a weight of aerosol per puff. The data of Comparative Example 8 was measured under the same experimental conditions, and the two groups of data were compared to measure the smoke quantity of the water-based electronic cigarette liquid. Specific data was shown in Table 11:

TABLE 11

Comparison of average smoke quantity (μg/puff) of water-based electronic cigarette liquid and traditional electronic cigarette liquid

| | Average atomization quantity | | | |
|---|---|---|---|---|
| Smoking stage | Example 20 | Example 30 | Example 32 | Comparative Example 8 |
| First 50 puffs | 1.12 | 0.88 | 1.12 | 1.71 |
| 50 to 100 puffs | 1.13 | 0.87 | 1.13 | 1.72 |
| 100 to 150 puffs | 1.08 | 0.82 | 1.08 | 1.68 |
| 150 to 200 puffs | 1.09 | 0.84 | 1.09 | 1.64 |

The data of Table 11 proved that the addition of a smoke producing agent significantly improved the smoke quantity of the water-based electronic cigarette liquid. Its data was only slightly lower than that of the traditional electronic cigarette liquid. The electronic cigarette liquid was directly smoked on a small smoking set, and its smoke quantity was acceptable under observation by naked eye.

According to the data of Table 11 and smoking evaluation experiments, the following conclusion was drawn: the smoke quantity of the water-based electronic cigarette liquid was slightly smaller than that of traditional glycerin and propylene glycol electronic cigarette oil. The water-based electronic cigarette liquid was suitable for smoking groups in pursuit of small smoke quantity.

During the above experimental process, the atomization effect floating value of the water-based electronic cigarette liquid was $S_{EFFECT}$, the number of puffs of the water-based electronic cigarette liquid was n, the atomization quantity corresponding to the i-th puff of the water-based electronic cigarette liquid was $S_i$, the average atomization quantity of the water-based electronic cigarette liquid per puff was $\overline{S}$, and the above parameters of Examples 20, 30 and 35 satisfied:

$$S_{EFFECT} = \frac{\sqrt{\frac{\sum_{i=1}^{n}(S_i - \overline{S})^2}{n-1}}}{S} \leq 0.1.$$

The atomization effect floating value of the water-based electronic cigarette liquid can be obtained from the above formula. After a large number of experimental assays, it can be confirmed that the propylene glycol-free water-based electronic cigarette liquid containing glycerol or not had a very stable atomization effect, and the atomization effect floating value was always kept less than 0.1.

Test for Specific Heat Capacity of Electronic Cigarette Liquid

Specific heat capacities of the electronic cigarette liquid of Examples 25, 26 and 27 and Comparative Example 8 at normal temperature under normal pressure were respectively measured.

TABLE 12

Comparison of specific heat capacities of water-based electronic cigarette liquid and traditional electronic cigarette liquid

| Number | Specific heat capacity/(J/(g · ° C.)) |
|---|---|
| Example 25 | 3.40 |
| Example 26 | 3.50 |
| Example 27 | 3.32 |
| Comparative Example 8 | 2.57 |

It can be seen from Table 12 that the specific heat capacities of water-based electronic cigarette liquids of various formulas were higher than that of the traditional electronic cigarette liquid, which can prevent excessive heating of electronic cigarettes, resulting in cracking of organic ingredients to produce a large amount of harmful substances.

Test for Boiling Point of Electronic Cigarette Liquid

Boiling points of the electronic cigarette liquid of the following examples and Comparative Example 8 under normal pressure were respectively measured.

TABLE 13

Comparison of boiling points of water-based electronic cigarette liquid and traditional electronic cigarette liquid

| Number | Boiling point/(° C.) |
|---|---|
| Example 12 | 106 |
| Example 25 | 107 |
| Example 26 | 108 |
| Example 27 | 108 |
| Example 53 | 105 |
| Example 54 | 103 |
| Example 55 | 108 |
| Example 56 | 103 |
| Example 57 | 111 |
| Example 58 | 108 |
| Example 59 | 104 |
| Comparative Example 8 | 197 |

It can be seen from Table 13 that the boiling points of water-based electronic cigarette liquids of various formulas were relatively close and obviously lower than that of traditional electronic cigarette liquid. The water-based electronic cigarette liquid had a lower boiling point, and can be atomized at lower heating temperature and less heat supply to form an aerosol.

Test for Viscosity of Electronic Cigarette Liquid

Viscosities of the electronic cigarette liquid of the following examples and Comparative Example 8 at normal temperature under normal pressure were measured.

TABLE 14

Comparison of viscosities of water-based electronic cigarette liquid and traditional electronic cigarette liquid

| Number | Viscosity/(mPa · S) |
|---|---|
| Example 12 | 6 |
| Example 25 | 9 |
| Example 26 | 12 |
| Example 27 | 9 |

TABLE 14-continued

Comparison of viscosities of water-based electronic cigarette liquid and traditional electronic cigarette liquid

| Number | Viscosity/(mPa · S) |
|---|---|
| Example 53 | 2 |
| Example 54 | 1.1 |
| Example 55 | 14 |
| Example 56 | 5 |
| Example 57 | 15 |
| Example 58 | 7 |
| Example 59 | 4 |
| Comparative Example 8 | 250 |

From Table 14, it can be obtained by comparing the physical and chemical properties of the water-based electronic cigarette liquid and the traditional electronic cigarette liquid that the water-based electronic liquid had a lower viscosity and better fluidity, which can bring many advantages in the aspect of smoking set design.

Smoke Atomization Measurement

Electronic cigarette liquid samples were respectively prepared according to the material proportion of the examples in Table 14 and Comparative example 8, then the electronic cigarette liquid was filled into a low frequency oscillator, the oscillator was opened after the electronic cigarette liquid was fully stood, and the smoke situation in the oscillator was observed; if continuous and obvious smoke was produced in the oscillator, it can be considered that the electronic cigarette liquid can produce smoke, and √ was marked; if continuous and obvious smoke cannot be produced in the oscillator, it can be considered that the electronic cigarette liquid cannot produce smoke, and x was marked. The test results were sequentially recorded in Table 14 to obtain the following test results:

TABLE 15

Test results of smoke of electronic cigarette liquid on low frequency oscillator

| Number | Viscosity/(mPa · S) | Smoke |
|---|---|---|
| Example 12 | 6 | ✓ |
| Example 25 | 9 | ✓ |
| Example 26 | 12 | ✓ |
| Example 27 | 9 | ✓ |
| Example 53 | 2 | ✓ |
| Example 54 | 1.1 | ✓ |
| Example 55 | 14 | ✓ |
| Example 56 | 5 | ✓ |
| Example 57 | 15 | ✓ |
| Example 58 | 7 | ✓ |
| Example 59 | 4 | ✓ |
| Comparative Example 8 | 250 | x |

From the contrast of Table 15, compared to ordinary electronic cigarette oil, the electronic cigarette liquid of the present invention had a lower viscosity, and can produce smoke in the low frequency oscillator. The low frequency oscillator had low operating power, which can reduce the energy consumption of the oscillator, prolong the service time of the oscillator and improve the convenience of using the oscillator by users. In addition, because the low frequency oscillator had low operating power, and the mechanical movement of oscillation was slow, little heat was generated during operation. The low frequency oscillation had lower operating temperature than high frequency oscillation, so that harmful substances in smoke were reduced, and the electronic cigarette liquid had better safety than ordinary electronic cigarette oil.

The low viscosity, low boiling point, high specific heat capacity electronic cigarette liquid of Examples 25, 26 and 27 above were placed in new electronic cigarette smoking sets and continuously heated five turns from half filling to dry burning, and no carbonized coking phenomenon was found. The electronic cigarette liquid of Comparative Example 8 was placed in a new electronic cigarette smoking set and continuously heated five turns from half filling to dry burning, and a carbonized coking phenomenon was found.

The forgoing descriptions are only preferred embodiments of the present application, and do not limit the present application in any form. Although the present application is disclosed above with the preferred embodiments, the present application is not limited thereto. Some variations or modifications made by any skilled person familiar with the art using the disclosed technical contents without departing from the scope of the technical solution of the present application are equivalent to the embodiments, and all fall within the scope of the technical solution.

The terms and expressions based herein are only used for description, and the present invention should not be limited to these terms and expressions. These terms and expressions do not exclude any (or some) schematic and described equivalent features, and it should be recognized that various possible modifications should also be included within the scope of the claims. Other modifications, changes and substitutions may also exist. Accordingly, the claims should be considered to cover all of these equivalents.

It should also be noted that, although the present invention is described with reference to the current specific embodiments, those of ordinary skill in the art should recognize that the above embodiments are merely used to illustrate the present invention, and various equivalent changes or substitutions may also be made without departing from the spirit of the present invention. Therefore, any changes and modifications made to the above embodiments within the essence and spirit of the present invention shall fall into the scope of the claims of the present invention.

The invention claimed is:

1. A water-based electronic cigarette liquid, comprising following ingredients in parts by mass:

40-60 parts of water;

20-50 parts of smoke providing ingredient which is solid at normal temperature and is soluble in water, wherein the smoke providing ingredient is sugar alcohol, and the sugar alcohol is a mixture of erythritol, sorbitol and xylitol with a mass ratio of erythritol to xylitol ranging from 1:1 to 1:4 and a mass ratio of erythritol to sorbitol ranging from 1:1 to 1:4, or the sugar alcohol is a mixture of erythritol and xylitol with a mass ratio of erythritol to xylitol ranging from 1:1 to 1:4; and 0-20 parts of glycerol.

2. The water-based electronic cigarette liquid according to claim 1, wherein a viscosity of the water-based electronic cigarette liquid is less than or equal to 200 mPa·s.

3. The water-based electronic cigarette liquid according to claim 1, wherein a boiling point of the water-based electronic cigarette liquid is less than or equal to 180° C.

4. The water-based electronic cigarette liquid according to claim 1, wherein a specific heat capacity of the water-based electronic cigarette liquid is more than or equal to 2.8 J/(g·° C.).

5. The water-based electronic cigarette liquid according to claim 1, wherein:

the water-based electronic cigarette liquid has an average atomization quantity more than or equal to 0.80 μg/puff during smoking, and an atomization quantity is a weight of aerosol captured.

6. The water-based electronic cigarette liquid according to claim 1, wherein the water-based electronic cigarette liquid has an average formaldehyde content less than or equal to 1.00 μg/puff and an average acetaldehyde content less than or equal to 0.5 μg/puff during smoking.

7. The water-based electronic cigarette liquid according to claim 1, wherein the water-based electronic cigarette liquid consists of following ingredients in parts by mass:

20-30 parts of sugar alcohol, 0-10 parts of glycerol, and 40 parts of water.

8. The water-based electronic cigarette liquid according to claim 1, wherein the water-based electronic cigarette liquid further comprises substances for increasing fragrance and/or a tobacco extract.

9. The water-based electronic cigarette liquid according to claim 8, wherein the substances for increasing fragrance comprise cigarette essence and/or cigarette flavor.

10. The water-based electronic cigarette liquid according to claim 8, wherein the water-based electronic cigarette liquid comprises 0-20 parts by weight of tobacco extract.

11. The water-based electronic cigarette liquid according to claim 8, wherein the water-based electronic cigarette liquid comprises 0.01-10 parts of substances for increasing fragrance.

12. A water-based electronic cigarette liquid, comprising following ingredients in parts by mass:

40-60 parts of water; and 20-50 parts of smoke providing ingredient which is solid at normal temperature and is soluble in water, wherein the smoke providing ingredient is sugar alcohol, and the sugar alcohol is a mixture of erythritol, sorbitol and xylitol with a mass ratio of erythritol to xylitol ranging from 1:1 to 1:4 and a mass ratio of erythritol to sorbitol ranging from 1:1 to 1:4, or the sugar alcohol is a mixture of erythritol and xylitol with a mass ratio of erythritol to xylitol ranging from 1:1 to 1:4.

13. The water-based electronic cigarette liquid according to claim 12, wherein the water-based electronic cigarette liquid does not comprise propylene glycol.

14. The water-based electronic cigarette liquid according to claim 13, wherein the water-based electronic cigarette liquid further comprises less than or equal to 20 parts of glycerin.

15. The water-based electronic cigarette liquid according to claim 12, wherein the water-based electronic cigarette liquid does not comprise glycerol or propylene glycol.

16. The water-based electronic cigarette liquid according to claim 12, wherein a boiling point of the water-based electronic cigarette liquid is less than or equal to 180° C.

17. The water-based electronic cigarette liquid according to claim 12, wherein a specific heat capacity of the water-based electronic cigarette liquid is more than or equal to 2.8 J/(g·° C.).

18. The water-based electronic cigarette liquid according to claim 12, wherein:

the water-based electronic cigarette liquid has an average atomization quantity more than or equal to 0.80 μg/puff during smoking, and an atomization quantity is a weight of aerosol captured.

19. The water-based electronic cigarette liquid according to claim 12, wherein the water-based electronic cigarette liquid has an average formaldehyde content less than or equal to 1.00 μg/puff and an average acetaldehyde content less than or equal to 0.5 μg/puff during smoking.

20. The water-based electronic cigarette liquid according to claim 12, wherein the water-based electronic cigarette liquid further comprises substances for increasing fragrance and/or a tobacco extract.

21. The water-based electronic cigarette liquid according to claim 11, wherein the substances for increasing fragrance and/or the tobacco extract comprise a mildew inhibitor.

22. The water-based electronic cigarette liquid according to claim 11, wherein the substances for increasing fragrance comprise cigarette essence and/or cigarette flavor.

23. The water-based electronic cigarette liquid according to claim 20, wherein the water-based electronic cigarette liquid comprises 0-20 parts by weight of tobacco extract.

24. The water-based electronic cigarette liquid according to claim 20, wherein the water-based electronic cigarette liquid comprises 0.01-10 parts of substances for increasing fragrance.

25. The water-based electronic cigarette liquid according to claim 12, wherein the water-based electronic cigarette liquid has a stable atomization effect during continuous smoking.

26. The water-based electronic cigarette liquid according to claim 25, wherein:

an atomization effect floating value of the water-based electronic cigarette liquid is $S_{EFFECT}$, a number of puffs of the water-based electronic cigarette liquid is n, an atomization quantity corresponding to i-th puff of the water-based electronic cigarette liquid is $S_i$, an average atomization quantity of the water-based electronic cigarette liquid per puff is $\overline{S}$, and above parameters satisfy $$S_{EFFECT} = \frac{\sqrt{\frac{\sum_{i=1}^{n}(S_i - \overline{S})^2}{n-1}}}{S} \leq 0.1.$$

27. The water-based electronic cigarette liquid according to claim 12, wherein a mass ratio of the water to the smoke providing ingredient is 1:4 to 4:1.

28. The water-based electronic cigarette liquid according to claim 23, wherein a mass ratio of the water to the smoke providing ingredient is 1:4 to 1:1.

* * * * *